United States Patent [19]

Lolli

[11] Patent Number: 5,035,447

[45] Date of Patent: Jul. 30, 1991

[54] BINDING ELEMENT FOR BINDING LOOSE SHEETS IN A FILE

[76] Inventor: Carla P. Lolli, J. Van Rijswijcklaan 76, 2018 Antwerpen, Belgium

[21] Appl. No.: 477,802

[22] PCT Filed: Jun. 16, 1989

[86] PCT No.: PCT/BE89/00028

§ 371 Date: Feb. 15, 1990

§ 102(e) Date: Feb. 15, 1990

[87] PCT Pub. No.: WO89/12554

PCT Pub. Date: Dec. 28, 1989

[30] Foreign Application Priority Data

Jun. 17, 1988 [BE] Belgium ..... 8800689

[51] Int. Cl.[5] ..... B42D 1/00; B42D 15/00

[52] U.S. Cl. ..... 281/15.001; 281/21.001; 412/900; 412/901

[58] Field of Search ..... 251/15.1, 21.1; 412/900, 901

[56] References Cited

U.S. PATENT DOCUMENTS 3,833,244 9/1974 Heimann ..... 281/21.1

4,441,950 4/1984 Lolli ..... 281/21.1

4,793,758 12/1988 Hanson et al. ..... 281/21.1 X

FOREIGN PATENT DOCUMENTS 869886 2/1978 Belgium .

8701029 5/1989 Belgium .

0140197 8/1985 European Pat. Off. .

2904456 2/1980 Fed. Rep. of Germany .

2027692 2/1970 France .

363325 9/1962 Switzerland .

365702 1/1963 Switzerland .

1239721 7/1971 United Kingdom .

*Primary Examiner*—Paul A. Bell

*Attorney, Agent, or Firm*—Foley & Lardner

[57] ABSTRACT

Binding element for binding loose sheets in a file, characterised in that it principally consists of a sheet (2) of relatively stiff material, that preferably shows the same dimensions as those of the documents to be bound; and a strip of glue (3), which extends past the sheet (2), installed over the whole length or over almost the whole length on the side of the sheet (2) which is destined to be placed next to the edge (6) of the bundle (5) to be bound.

12 Claims, 2 Drawing Sheets

Fig. 7
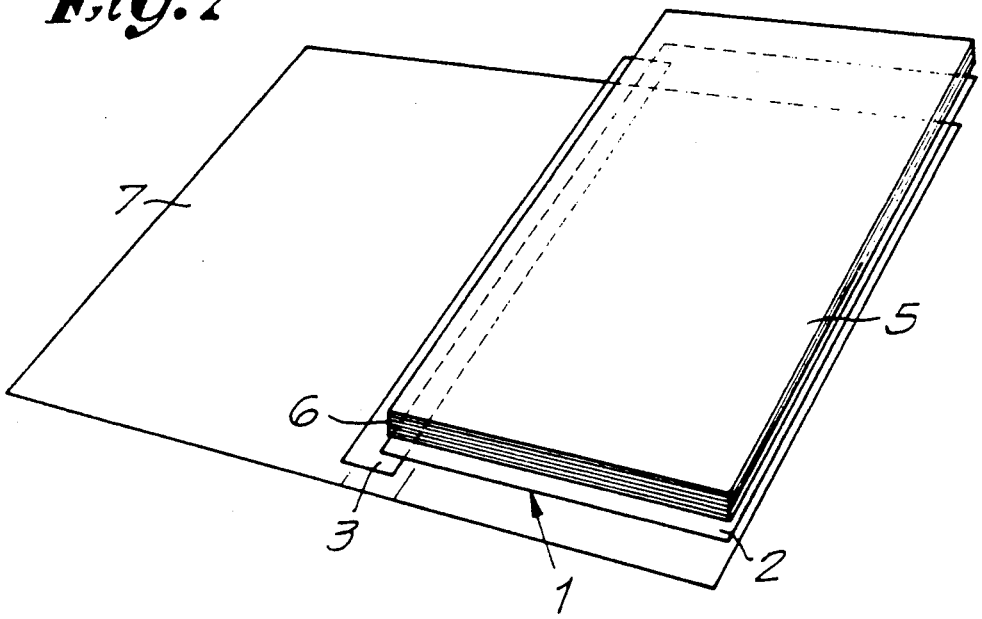
Fig. 8
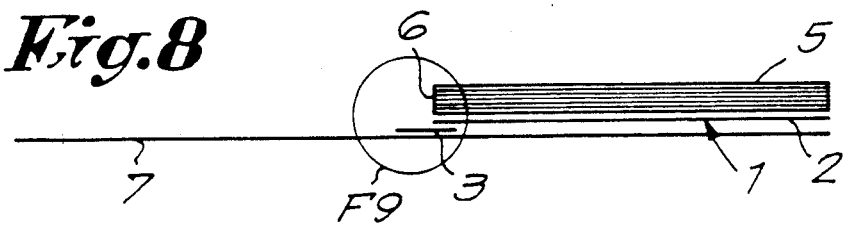
Fig. 9
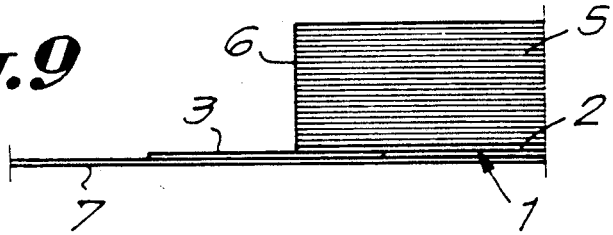
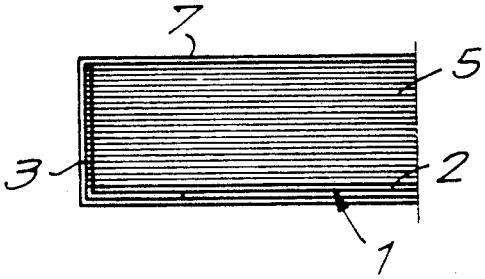
Fig. 10

BINDING ELEMENT FOR BINDING LOOSE SHEETS IN A FILE

BACKGROUND OF THE INVENTION

1. Field of the Invention

This invention relates to a binding element for binding loose sheets in files, so that files may be created in any material and in any position.

The present invention relates to a binding element provided with a layer of glue meltable under the influence of heat. The purpose of the glue is to attach an amount of sheets or documents to the binding element and, to secure the binding element with the bound documents in a suitable file.

2. Brief Description of the Prior Art

Files with a supple spine and with a layer of glue meltable under the influence of heat are already known, for example, files of the type described in the Belgian patent no. 869.886.

Since such files principally consist of an aforementioned spine, a front sheet and a back sheet, the utilisation of these files always remains limited to the use of the same cover.

A binding element which allows a bundle of documents to be bound and at the same time provides a simple attachment of such binding element in any cover is also already known.

Such an element is, for example, described in the Belgian patent no. 87 01 029.

This element consists of a small strip of material which may be stuck in any file and which is provided with a so-called layer of thermal glue. In one particular embodiment, this binding element consists of a small strip of material whose sides are extended by end papers.

In the first case, the binding element can only be installed with difficulty installed in the right place because of its small dimensions. In the second case, the binding element is relatively expensive due to the presence of a so-called front and back sheet, which are sheathed by the actual cover.

OBJECTS AND SUMMARY OF THE PRESENT INVENTION

The present invention has a binding element which not only allows a bundle of documents or similar materials to be bound, but which also allows the simple attachment of any cover around the bundle.

This feature permits the user of such binding elements a wide choice of cover when using the binding element. The element placed loose in such a cover together with the documents to be bound. After placement together binding is achieved by heating a layer of glue provided on the binding element cover may be formed of any material.

Such binding element is extremely simple. It also cheap and allows the binding to be implemented in a simple and effective manner.

This binding element of the invention principally comprises a relatively stiff sheet of any material, and the dimensions of which preferably correspond with those of the documents to be bound. This sheet is provided with a projecting part on one edge, specifically the edge which lies against the spine of the cover, and is formed by a layer of glue meltable under the influence of heat.

Depending on the material from which the sheet of the binding element is made the layer of glue will be either directly attached to the aforementioned sheet, or attached by means of a double sided adhesive strip.

BRIEF DESCRIPTION OF THE DRAWINGS

In order to better show the characteristics of the invention, two preferred embodiments are shown hereafter, as examples and without any restrictive character and with reference to the enclosed drawings, in which:

FIG. 7 shows a dismantled perspective view of a binding whereby use is made of a binding element according to FIG. 1;

FIG. 8 shows a cross-section of a binding element according to FIG. 7;

FIG. 9 shows on a larger scale the part indicated by F9 in FIG. 8;

FIG. 10 is a view similar to that from FIG. 9, but after the binding has been effected.

DETAILED DESCRIPTION OF THE PREFERRED EMBODIMENT

Figure 1:
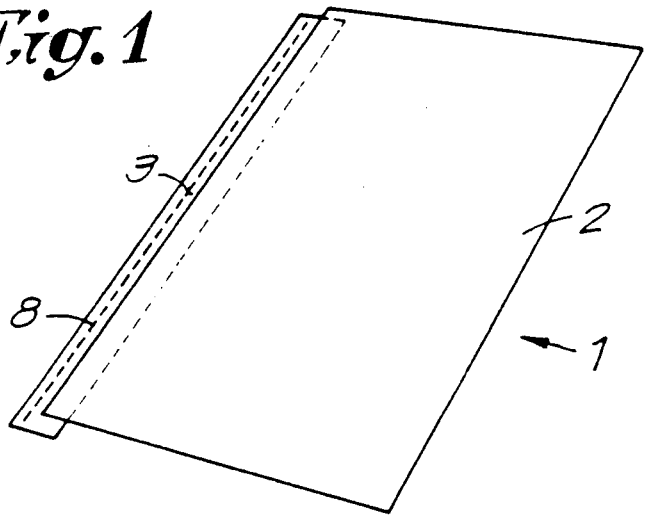
FIG. 1 shows a dismantled perspective view of a binding element according to the invention.
Figure 2:
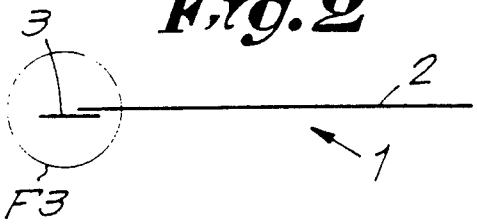
FIG. 2 shows a schematic cross-section of a binding element according to FIG. 1.
Figure 3:
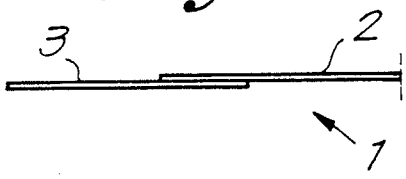
FIG. 3 shows on a larger scale the part indicated by F3 in FIG. 2.

In FIG. 1, a binding element 1 according to the invention is shown that comprises a sheet 2 of relatively stiff material, for example, thin cardboard, on which a strip, formed by a layer of glue 3 meltable under influence of heat, is provided. The edge of the strip will form the spine of the binding.

The glue will, depending on the material of which the sheet 2 consists, be attached to the latter by adhesion, melting or similar method.

Figure 4:
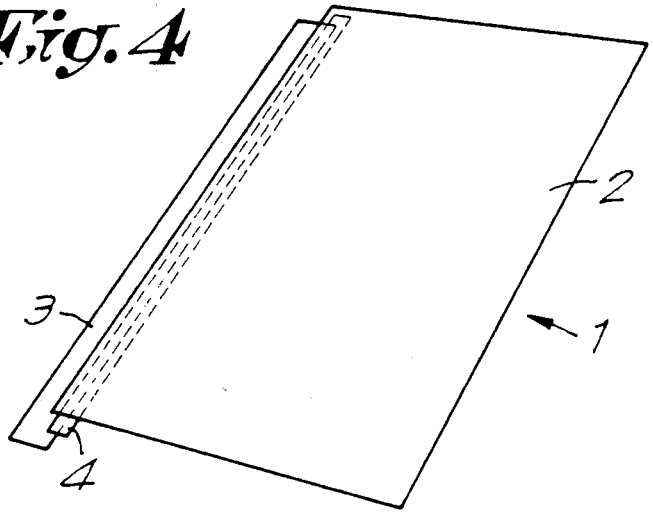
FIG. 4 is a view similar to that from FIG. 1 but for an embodiment variant.
Figure 5:
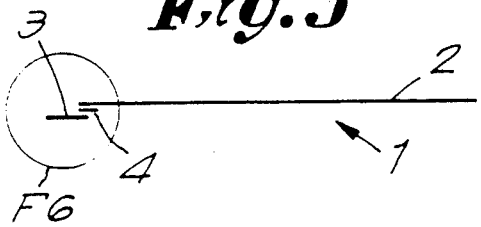
FIG. 5 shows a cross-section of a binding element according to FIG. 4.
Figure 6:
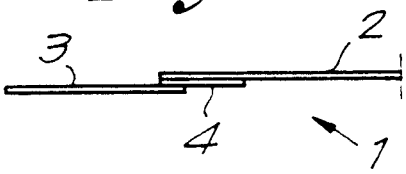
FIG. 6 shows on a larger scale the part indicated by F6 in FIG. 5.

A variant is shown in the FIGS. 4 through 6 whereby the strip of glue 3 is attached to the sheet 2 by a double sided adhesive tape 4.

The use of the binding element is extremely simple.

It is sufficient to place a bundle of documents 5 on the sheet 2 so that a side edge 6 of this bundle is placed opposite the strip of glue 3. This is shown in the FIGS. 7 through 9.

Subsequently, the binding element 1 along with bundle of documents 5 is placed on a file of any material. The file is folded shut around the binding element 1 and bundle of documents 5, through in such a way that the glue is placed against the edge 6 of the bundle 5. In other words glue is placed between the bundle 5 and the spine of the file 7.

At this moment, it is sufficient to heat the spine of the file 7 and therefore the strip of glue 3 in order to make the latter melt, the sheets 5 are thus bound together and, attached to the spine of the file 7.

It is clear that the binding element 1, the bundle of documents 5 and the file 7 may, of course, also be brought together in any other sequence.

To facilitate the folding of the layer of glue 3, which is especially important when this layer is wider than the thickness of the bundle of documents 5 to be bound, this layer can be provided with one or more lines of perforations over at least a part of its length. These perforations are indicated schematically by 8 in FIG. 1.

It is clear that through the present invention, a very simple and economical binding element 1 is achieved that allows a bundle of documents to be attached in an extremely simple manner in any file of any material.

The present invention is in no way restricted to the embodiments described as examples and shown in the drawings, but may be developed in all kinds of forms and dimensions without departing from the scope of the present invention.

I claim:

1. A binding element for binding loose sheets in a file comprising:

a sheet of relatively stiff material; and a strip of glue meltable under the influence of heat positioned along at least a portion of a side of the sheet and extending beyond the side of the sheet, the strip of glue having a pair of adhesable exposed surfaces, the strip of glue further being attached to the sheet but unattached to any other non-adhesive or backing material.

2. A binding element according to claim 1, wherein the sheet is formed of thin cardboard.

3. A binding element according to claim 1, wherein the strip of glue is attached to the sheet by an adhesive means.

4. A binding element according to claim 1, wherein the strip of glue is attached to the sheet by melting the strip.

5. A binding element according to claim 1, wherein the strip of glue is attached to the sheet by means of a strip of double sided adhesive tape.

6. A method of binding loose sheets in a file comprising:

(a) providing a file which folds shut along a spine;

(b) providing a binding element comprising:

a sheet of relatively stiff material; and a strip of glue meltable under the influence of heat positioned along at least a portion of a side of the sheet and extending beyond the side of the sheet, the strip of glue having a pair of adhesable exposed surfaces, the strip of glue further being attached to the sheet but unattached to any other non-adhesive or backing material;

(c) placing the binding element and a bundle of loose sheets on the file so that folding the file positions the glue strip against an edge of the bundle and between the bundle and the spine of the file; and (d) heating the spine and causing the glue to melt thereby binding the sheets of the bundle to each other and to the spine of the file.

7. A binding element according to claim 1, wherein the strip of glue has at least one perforation line.

8. The method of binding according to claim 6, wherein the sheet is formed of thin cardboard.

9. The method of binding according to claim 6, including attaching the strip of glue to the sheet by an adhesive means.

10. The method of binding according to claim 6, including attaching the strip of glue to the sheet by melting the strip.

11. The method of binding according to claim 6, including attaching the strip of glue to the sheet by means of a strip of double sided adhesive tape.

12. The method of binding according to claim 6, including forming the strip of glue with at least one perforation line.

* * * * *